US006938870B1

(12) United States Patent
Salvador

(10) Patent No.: US 6,938,870 B1
(45) Date of Patent: Sep. 6, 2005

(54) BOOK SUPPORT APPARATUS

(76) Inventor: Donna San Salvador, 3706 Broadway #23, Fort Myers, FL (US) 33901

( * ) Notice: Subject to any disclaimer, the term of this patent is extended or adjusted under 35 U.S.C. 154(b) by 0 days.

(21) Appl. No.: 10/866,613

(22) Filed: Jun. 14, 2004

(51) Int. Cl.[7] ..... A47B 19/00
(52) U.S. Cl. ..... 248/441.1; 248/448; 248/451; 248/910
(58) Field of Search ..... 248/441.1, 447, 248/448, 446, 451, 910

(56) References Cited

U.S. PATENT DOCUMENTS

| | | | | |
|---|---|---|---|---|
| 2,612,721 | A | 10/1952 | Pollard | |
| 3,606,235 | A | 9/1971 | Young | |
| 4,116,414 | A * | 9/1978 | Robertson | 248/451 |
| 4,145,044 | A * | 3/1979 | Wilson et al. | 473/483 |
| 4,372,518 | A * | 2/1983 | Biasini | 248/441.1 |
| 4,801,120 | A | 1/1989 | Gregoire | |
| 5,088,677 | A * | 2/1992 | Chandler et al. | 248/451 |
| 5,161,766 | A | 11/1992 | Arima | |
| 5,356,109 | A * | 10/1994 | Biasini | 248/448 |
| 5,692,719 | A * | 12/1997 | Shepherd | 248/460 |
| 5,810,316 | A * | 9/1998 | Eby | 248/451 |
| 5,855,329 | A * | 1/1999 | Pagano | 248/451 |
| D404,933 | S | 2/1999 | Travers | |
| 5,884,888 | A | 3/1999 | Grimes, III et al. | |
| 5,971,344 | A | 10/1999 | Ainsworth | |
| 6,027,092 | A | 2/2000 | Gordon | |
| 6,202,973 | B1 | 3/2001 | Navarin et al. | |
| 6,293,511 | B1 * | 9/2001 | Shepherd | 248/441.1 |
| 6,446,930 | B1 * | 9/2002 | Li | 248/519 |

* cited by examiner

*Primary Examiner*—Ramon O Ramirez

(57) ABSTRACT

A book support apparatus includes a base and a post that has a bottom end and a top end. The bottom end is removably coupled to the base. A rod has first end and a second end. The first end is attached to the top end of the post. The rod is adapted for being selectively bendable into a shape such that the rod retains the shape. A panel has a first side edge, a second side edge, a front side and a back side. The second end of the rod is attached to the back side. Slots extend into the first and second side edges. Each of a pair of plates is removably extended into one of the slots. The plates each have an outer edge. Each of a pair of securing members is attached to one of the outer edges for attaching a book to the plates.

9 Claims, 3 Drawing Sheets

BOOK SUPPORT APPARATUS

BACKGROUND OF THE INVENTION

1. Field of the Invention

The present invention relates to book stand devices and more particularly pertains to a new book stand device for supporting a book in an open position so that book may be easily read.

2. Description of the Prior Art

The use of book stand devices is known in the prior art. U.S. Pat. No. 5,884,888 describes a device that includes a planar base for positioning below a mattress or may be sat upon so that a book supported by the device is stabilized and supported in front of a person. Another type of book stand device is U.S. Pat. No. 4,801,120 having a floor engaging base and a post extending upwardly from the base. A book support is attached to an end of the post. The post has a joint therein so that the book support may be moved with respect to base. U.S. Pat. No. 5,161,766 describes yet another book holding assembly that again includes a base which may be positioned underneath a person intending to use the assembly.

While these devices fulfill their respective, particular objectives and requirements, the need remains for a device that includes a base that may be selectively weighted to allow a user of the device to selectively determine how heavy the base must be in order to stabilize a book supported by the base. The device should also include a means for allowing a user of the device to determine the orientation of the book.

SUMMARY OF THE INVENTION

The present invention meets the needs presented above by generally comprising a base and a post that has a bottom end and a top end. The bottom end is removably coupled to the base. A rod has first end and a second end. The first end is attached to the top end of the post. The rod is adapted for being selectively bendable into a shape such that the rod retains the shape. A panel has an upper edge, a lower edge, a first side edge, a second side edge, a front side and a back side. The second end of the rod is attached to the back side of the panel. Each of the first and second side edges has a slot extending therein. Each of a pair of plates is removably extended into one of the slots. The plates each have an outer edge extending outwardly away from the panel. Each of a pair of securing members is attached to one of the outer edges and each is adapted for attaching a book to the plates.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
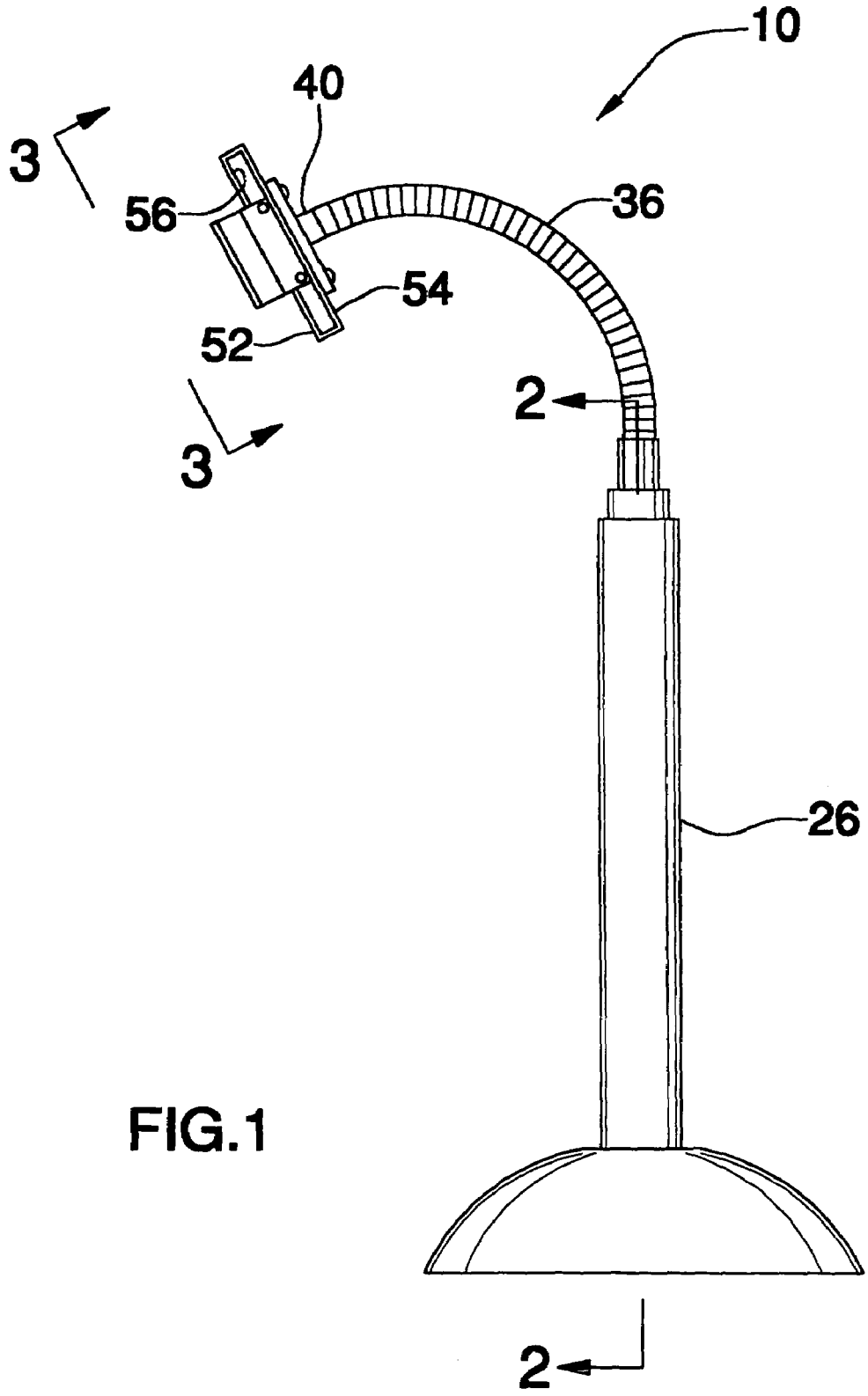
FIG. 1 is a side view of a book support apparatus according to the present invention.
Figure 2:
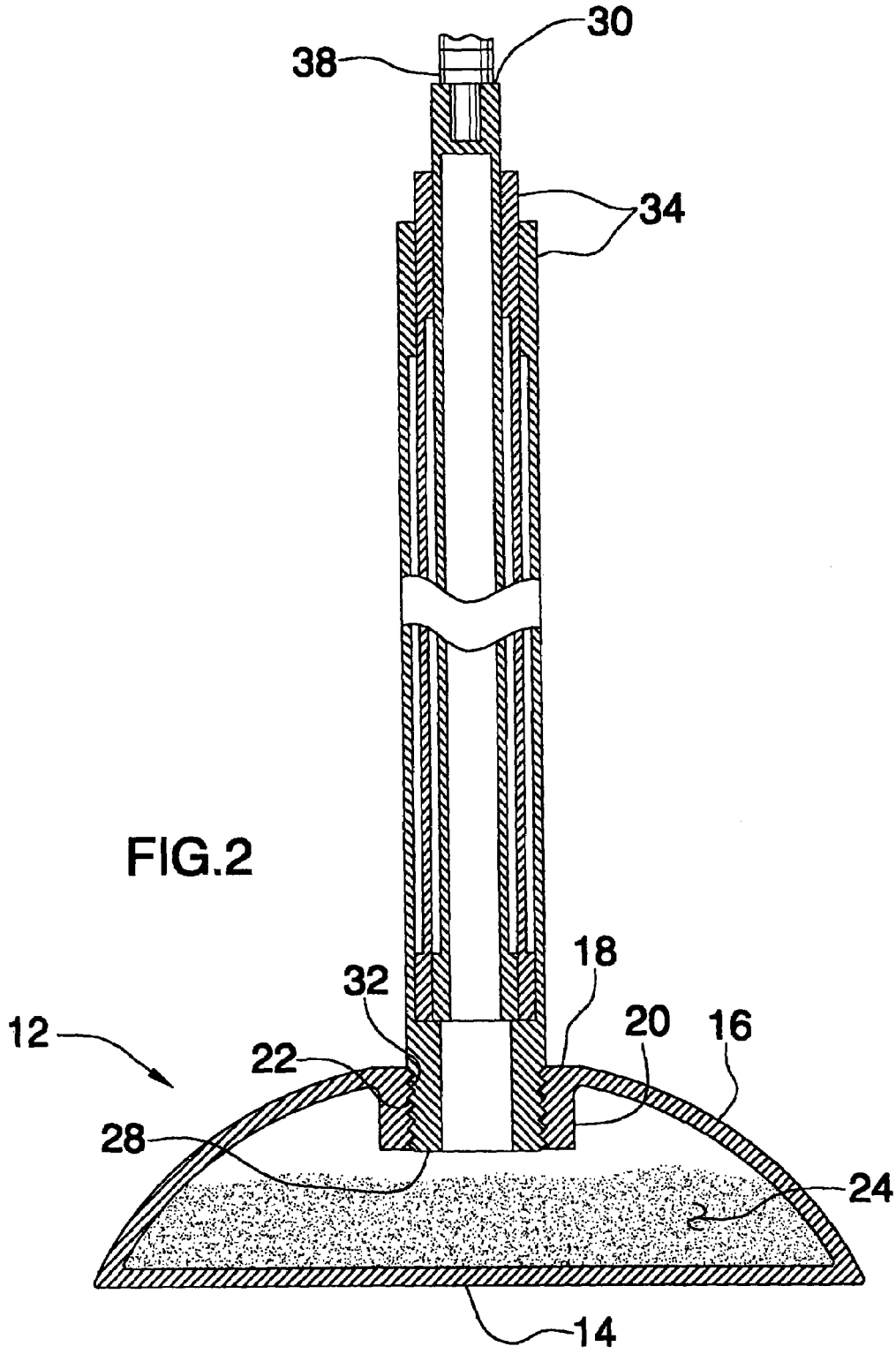
FIG. 2 is a cross-sectional view taken along line 2—2 of FIG. 1 of the present invention.
Figure 3:
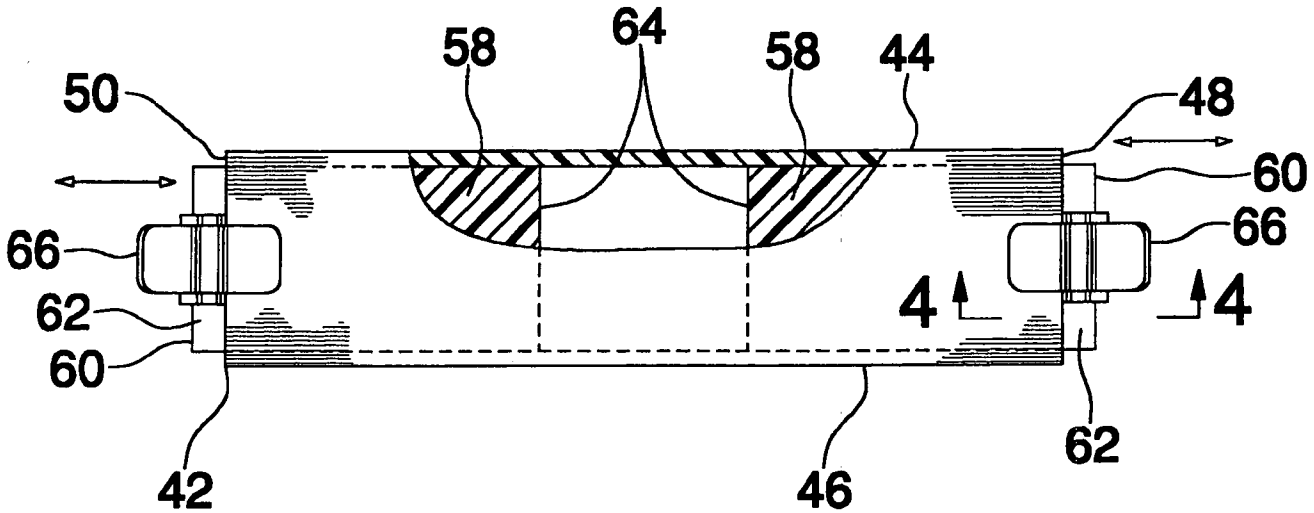
FIG. 3 is a front view of the panel of the present invention.
Figure 4:
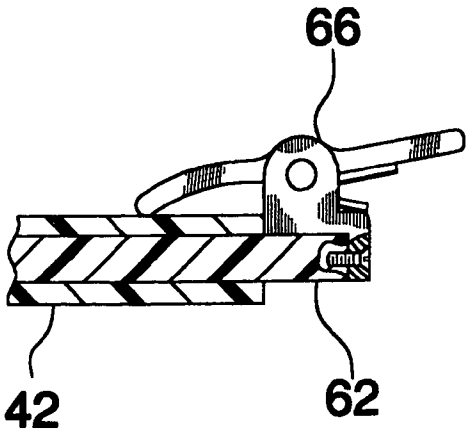
FIG. 4 is a cross-sectional view taken along line 4—4 of FIG. 3 of the present invention.

With reference now to the drawings, and in particular to FIGS. 1 through 4 thereof, a new book stand device embodying the principles and concepts of the present invention and generally designated by the reference numeral 10 will be described.

As best illustrated in FIGS. 1 through 4, the book support apparatus 10 generally comprises a base 12 that has a substantially hollow interior. The base 12 has a substantially planar bottom wall 14 and a domed top wall 16. The top wall 16 has an aperture 18 extending therethrough. A neck 20 is integral with and extends downwardly from an edge of the aperture 18 such that the neck 20 extends into the interior. The neck 20 has a threaded inner surface 22. The bottom wall 14 is preferably circular and has a diameter generally between 6 inches and 8 inches. A weighting material 24 may be selectively positioned within the base 12. The weighting material 24 preferably includes sand or water and may be selectively added or removed from the base 12 depending on the needs of a user of the apparatus 10.

A post 26 has a bottom end 28 and a top end 30. The bottom end 28 is removably coupled to the base 12. The post 26 has a threaded outer surface 32 adjacent to the bottom end 28. The threaded outer surface 32 is selectively engaged with the threaded inner surface 22 such that the post 26 extends upwardly from the base 12. By removing the post 26, the user may add or remove the weighting material 24. The post 26 is selectively telescoping and includes a plurality of sections 34 that are removably extended into each other. It is preferred that friction holds the sections 34 together and within their position as determined by the user of the post 26. Alternatively, pins or outwardly biased members may be used instead which are extended through sections 34.

A rod 36 has first end 38 and a second end 40. The first end 38 is attached to the top end 30 of the post 26. The rod 36 is adapted for being selectively bendable into a shape such that the rod 36 retains the shape. Such rods 36 are conventionally called goosenecks and are commonly used for microphone supports and the like.

A panel 42 has an upper edge 44, a lower edge 46, a first side edge 48, a second side edge 50, a front side 52 and a back side 54. The second end 40 of the rod 36 is attached to the back side 54 of the panel 42. Each of the first 48 and second 50 side edges has a slot 56 extending therein. Each of the slots 56 generally extends from the lower edge 46 to the upper edge 44. The panel 42 has a length from the first side edge 48 to the second side edge 50 generally between 8 inches and 12 inches. The panel 42 has a height from the lower edge 46 to the upper edge 44 generally between 3 inches and 5 inches and more preferably equal to about 4 inches. The small height of the panel 42 reduces the overall weight and volume of the apparatus 10 to make it more portable.

Each of a pair of plates 58 is removably extended into one of the slots 56. Each of the plates 58 has an outer edge 60 extending outwardly away from the panel 42. The plates 58 each have a forward side 62 facing in the same direction as the front side 52 of the panel 42. The plates 58 also each have an inner edge 64 positioned within the panel 42. The plates 58 each have a length from their inner edges 64 to their outer edges 60 generally between 4 inches 6 inches. This allows the user of the apparatus 10 to selectively increase the length of the front side 52 of the panel 42.

Each of a pair of securing members 66 is attached to one of the outer edges 60 and is adapted for attaching a book to the plates 58. Each of the securing members 66 each preferably comprises a clip biased against the forward side 62 of the plates 58.

In use, the plates 58 are extended outwardly from the panel 42 so that the panel 42 is the required size for a book to be attached to the panel 42. Also, the required amount of weighting material 24 is positioned within the base 12 to ensure that the apparatus 10 is stable once a book is positioned attached to the apparatus 10. The securing members 66 are used for attaching a book or other reading material to the plates 58, and thereby against the panel 42, so that the book is placed in an open position. The rod 36 is then shaped so that the book is orientated as desired by the user of the apparatus 10 so that the book may be easily read. The weighting material 24 may be removed when the user of the apparatus desires to transport the apparatus 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A book support apparatus comprising:

a base having a substantially hollow interior, said base having a top wall having an aperture extending therethrough;

a weighting material being selectively positionable into said base through said aperture and selectively removable out of said base through said aperture;

a post having a bottom end and a top end, said bottom end being removably extendable into said aperture and coupled to said base;

a rod having first end and a second end, said first end being attached to said top end of said post, said rod being adapted for being selectively bendable into a shape such that said rod retains the shape;

a panel having an upper edge, a lower edge, a first side edge, a second side edge, a front side and a back side, said second end of said rod being attached to said back side of said panel, each of said first and second side edges having a slot extending therein;

a pair of plates, each of said plates being removably extended into one of said slots, each of said plates having an outer edge extending outwardly away from said panel; and a pair of securing members, each of said securing members being attached to one of said outer edges and being adapted for attaching a book to said plates.

2. The apparatus according to claim 1, wherein each of said plates has a forward side facing in the same direction as said front side of said panel, each of said securing members comprising a clip biased against said forward side of said plates.

3. The apparatus according to claim 1, wherein said base has a substantially planar bottom wall and a domed top wall, a neck being integral with and extending downwardly from an edge of said aperture such that said neck extends into said interior, said neck having a threaded inner surface, said post having a threaded outer surface adjacent to said bottom end, said threaded outer surface being selectively engaged with said threaded inner surface such that said post extends upwardly from said base.

4. The apparatus according to claim 3, wherein said post is selectively telescoping.

5. The apparatus according to claim 1, wherein said post is selectively telescoping.

6. The apparatus according to claim 3, wherein said panel has a length from said first side edge to said second side edge generally between 8 inches and 12 inches and a height from said lower edge to said upper edge generally between 3 inches and 5 inches.

7. The apparatus according to claim 6, wherein each of said plates has a forward side facing in the same direction as said front side of said panel, each of said securing members comprising a clip biased against said forward side of said plates.

8. The apparatus according to claim 1, wherein said panel has a length from said first side edge to said second side edge generally between 8 inches and 12 inches and a height from said lower edge to said upper edge generally between 3 inches and 5 inches.

9. A book support apparatus comprising:

a base having a substantially hollow interior, said base having a substantially planar bottom wall and a domed top wall, said top wall having an aperture extending therethrough, a neck being integral with and extending downwardly from an edge of said aperture such that said neck extends into said interior, said neck having a threaded inner surface, a weighting material being removably positioned within said base;

a post having a bottom end and a top end, said bottom end being removably coupled to said base, said post having a threaded outer surface adjacent to said bottom end, said threaded outer surface being selectively engaged with said threaded inner surface such that said post extends upwardly from said base, said post being selectively telescoping;

a rod having first end and a second end, said first end being attached to said top end of said post, said rod being adapted for being selectively bendable into a shape such that said rod retains the shape;

a panel having an upper edge, a lower edge, a first side edge, a second side edge, a front side and a back side, said second end of said rod being attached to said back side of said panel, each of said first and second side edges having a slot extending therein, each of said slots generally extending from said lower edge to said upper edge, said panel having a length from said first side edge to said second side edge generally between 8 inches and 12 inches, said panel having a height from said lower edge to said upper edge generally between 3 inches and 5 inches;

a pair of plates, each of said plates being removably extended into one of said slots, each of said plates having an outer edge extending outwardly away from said panel, each of said plates having a forward side facing in the same direction as said front side of said panel; and a pair of securing members, each of said securing members being attached to one of said outer edges and being adapted for attaching a book said plates, each of said securing members comprising a clip biased against said forward side of said plates.

* * * * *